US006070340A

United States Patent [19]

Lipponen

[11] Patent Number: 6,070,340

[45] Date of Patent: Jun. 6, 2000

[54] CYLINDER GROUP PROVIDED WITH SINGLE-WIRE DRAW IN THE DRYER SECTION OF A PAPER MACHINE AND DRYER SECTION THAT INCLUDED SUCH CYLINDER GROUPS

[75] Inventor: Juha Lipponen, Palokka, Finland

[73] Assignee: Valmet Corporation, Helsinki, Finland

[21] Appl. No.: 09/062,048

[22] Filed: Apr. 17, 1998

Related U.S. Application Data

[60] Provisional application No. 60/044,984, Apr. 28, 1997.

[30] Foreign Application Priority Data

Apr. 28, 1997 [FI] Finland ..... 971666

[51] Int. Cl.[7] ..... D06F 58/00

[52] U.S. Cl. ..... 34/117

[58] Field of Search ..... 34/117, 116, 120, 34/122, 123

[56] References Cited

U.S. PATENT DOCUMENTS

| | | | |
|---|---|---|---|
| 4,850,121 | 7/1989 | Ely | 34/116 |
| 5,022,163 | 6/1991 | Ilvespaa et al. | 34/23 |
| 5,279,050 | 1/1994 | Tormanen | 34/117 |
| 5,539,999 | 7/1996 | Kuhasalo | 34/455 |

FOREIGN PATENT DOCUMENTS

| | | |
|---|---|---|
| 83246 | 10/1987 | Finland . |
| 3910612 | 10/1990 | Germany . |

*Primary Examiner*—Henry Bennett
*Assistant Examiner*—Malik N. Drake
*Attorney, Agent, or Firm*—Steinberg & Raskin, P.C.

[57] ABSTRACT

A dryer group with single-wire draw in the dryer section of a paper machine including heated drying cylinders having a smooth face against which a paper web to be dried is brought into direct contact, reversing cylinders and a drying-wire guided by guide rolls, the drying cylinders and the reversing cylinders in a loop whereby the drying cylinders are situated outside the wire loop and the reversing cylinders are situated in gaps between the drying cylinders and inside the wire loop of the drying wire. The drying cylinders consist of large cylinders and small cylinders, the diameter D of the large cylinders being larger than the diameter d of the small cylinders. The small cylinders are situated in gaps between adjacent pairs of large cylinders so that their centers of rotation are on a level substantially different from the level of the centers of rotation of the large cylinders. The reversing cylinders are situated on the runs of the drying wire and the web from a large cylinder to a small cylinder and from a small cylinder to a large cylinder. The centers of rotation of the reversing cylinders is on a level or levels different from the corresponding levels of the large cylinders and the small cylinders.

30 Claims, 6 Drawing Sheets

CYLINDER GROUP PROVIDED WITH SINGLE-WIRE DRAW IN THE DRYER SECTION OF A PAPER MACHINE AND DRYER SECTION THAT INCLUDED SUCH CYLINDER GROUPS

This case is a continuation of provisional application 60/044,984 filed Apr. 28, 1997.

FIELD OF THE INVENTION

The present invention relates to a group with single-wire draw in a dryer section of a paper machine including a number of heated drying cylinders each having a smooth face against which a paper web to be dried is brought into direct contact, reversing cylinders, and a drying-wire guided by guide rolls in a loop around the drying cylinders and reversing cylinders so that the drying cylinders are situated outside the loop of the drying wire and the reversing cylinders are situated in gaps between the drying cylinders and inside the loop of the drying wire. The drying cylinders consist of large cylinders and small cylinders, the diameter D of the large cylinders being substantially larger than the diameter d of the small cylinders, D>d.

Further, the present invention relates to a dryer section of a paper machine exclusively or mainly composed of groups with single-wire draw as described above.

The present invention also relates to a method for reducing the length of a dryer section of a paper machine by utilizing single-wire draw groups as described above.

BACKGROUND OF THE INVENTION

In the prior art, in multi-cylinder dryers of paper machines, twin-wire draw and/or single-wire draw is/are employed. In a twin-wire draw, the groups of drying cylinders include two endless fabrics, belts or wires which press the web, one from above and the other one from below, against the heated cylinder faces. Between the rows of drying cylinders, which are usually horizontal rows, the web has free and unsupported draws. The free draws are susceptible to fluttering which may cause web breaks, in particular since the web is still relatively moist and, therefore, has a relatively low strength. For this reason, in recent years, increasing use has been made of a single-wire draw in which each group of drying cylinders has only one drying wire. The web runs on support of the drying wire through the entire group so that the drying wire presses the web on the drying cylinders against the heated cylinder faces thereof, and whereas, on the reversing cylinders or rolls arranged between the drying cylinders, the web remains at the side of the outside curve. Thus, in a single-wire draw, the drying cylinders are placed outside the drying wire loop and the reversing cylinders or rolls are situated inside the drying wire loop.

A dryer section that consists of normal groups with single-wire draw alone involves the drawback that the paper web is dried from the side of its lower face alone, which may cause a tendency of curling in the web. Therefore, it is known in the prior art, that when drying a paper web, dryer sections are used in which there are, for example, alternatingly so-called normal groups and inverted groups with single-wire draw. In the prior art, dryer sections are also known that consist exclusively of so-called normal groups with single-wire draw. Also, dryer sections are known in which all the other groups except the last group are normal groups with single-wire draw, whereas the last group is a group with twin-wire draw.

In the dryer sections mentioned above, various problems have occurred, for which problems the present invention suggests novel, efficient solutions. These problems include the large length of the dryer section, which increases the costs of the dryer section and the machine hall. Problems have also been encountered in the runnability of the dryer section, in the threading of the web, problems arising from differences in the speeds of different wires, as well as problems related to control of transverse shrinkage of the web. In inverted drying groups, in the event of breaks, a problem consists of the removal of broke, for inverted groups are not self-cleaning by the force of gravity. Generally, these problems tend to become worse as the running speed of the paper machine becomes higher.

In the prior art dryer-section constructions, the overall length of the dryer section becomes considerably large and this increases the cost of investment of a paper mill, above all the construction cost. If it were possible to reduce the length of the dryer section, it would also be possible to reduce the construction cost required by the paper mill in the same proportion.

Regarding the prior art related to the present invention, reference is made to Finnish Laid-open Publication No. 83,246 (applicant-Beloit Corporation, corresponding to U.S. Pat. No. 4,850,121), to German Patent No. 31 90 612 (applicant-J. M. Voith GmbH), as well as to the current assignee's Finnish Patent Application Nos. 913648 (corresponding to U.S. Pat. No. 5,279,050, incorporated by reference herein) and 940992 (corresponding to U.S. Pat. No. 5,539,999, incorporated by reference herein).

Of the prior art cited above, Finnish Patent Application Nos. 913648 and 940992 are most closely related to the present invention. Thus, another object of the present invention is further development of the geometry and the grouping of the cylinders in a group with single-wire draw described in these Finnish patent applications. In these Finnish patent applications, drying cylinders of two different diameters and reversing cylinders of two different diameters are used, of which cylinders the drying cylinders with larger diameter are placed in the uppermost horizontal level, and the reversing cylinders placed in the gaps between every other pair of upper drying cylinders and the drying cylinders of smaller diameter placed in the gaps between every other pair of cylinders are placed in the next, lower horizontal level. The last-mentioned reversing cylinders and drying cylinders have substantially equal diameters. In the lowest, third level, the reversing cylinders of smaller diameter are placed, which are placed in pairs at both sides of the gap between every other pair of upper drying cylinders, a drying cylinder of smaller diameter being placed above, and in the middle of, the gap between the pair of lower reversing cylinders. Drawbacks of the construction described in Finnish Patent Application 913648 include the fact that the drying cylinders and the reversing cylinders are placed at quite a large difference in height in relation to one another, so that servicing of the machine from one tending platform is difficult, and that, for the machine, both drying cylinders of two different diameters and reversing cylinders of two different diameters are needed, which increases the costs of manufacture and spare parts of the dryer section.

OBJECTS AND SUMMARY OF THE INVENTION

Accordingly, it is an object of the present invention to provide a novel dryer section that can also be applied to modernizations of paper machines, so that the drying capacity can be increased, for example, in connection with an increase in the running speed of the paper machine or in connection with a change of the paper grade to be produced. It is a typical example of a change of paper grade that a surface-sizing device is fitted in the final end of the dryer section, together with the finishing-dryer necessary after it. Thus, it is an object of the invention to provide a novel dryer section that is suitable for this purpose and by whose means the dryer section placed before the surface-sizing device can be made shorter while maintaining the drying capacity, so that the surface-sizing device and the finishing-dryer can be placed after the shorter dryer section in the place of the previous dryer section before the machine reel-up, which must, as a rule, be allowed to stay in its previous location.

Another object of the present invention is to provide a novel dryer section for a paper machine which is considerably shorter than the prior art dryer sections that have an equivalent drying capacity and number of cylinders.

It is another object of the present invention to eliminate the drawbacks described above with respect to the prior art constructions while, nevertheless, retaining the objectives aimed at in the above-referenced Finnish patent applications, i.e., to provide a dryer section of substantially shorter length in comparison to current dryer section, and in which dryer section the drying capacity is, however retained and a draw optimal in view of the operability of the dryer section is obtained for the web.

It is a further object of the invention to provide a dryer section that can be tended from one tending platform, which is a substantial advantage in comparison with the dryer sections of Finnish Patent Application No. 913648 described above and with the prior art so-called vertical dryer sections. In the invention, these objectives are achieved without undue increase in the costs of manufacture and spare parts of the dryer section. By means of an arrangement in accordance with the present invention, a dryer section is obtained which has been shortened further in comparison to the geometry described in Finnish Patent Application No. 940992.

In view of achieving the objectives stated above and those that will come out later, in a group with single-wire draw in accordance with the invention, a small cylinder is placed in a respective gap between at least one pair of adjacent large cylinders so that their centers of rotation are on a level substantially different from the level of the centers of rotation of the large cylinders, and reversing cylinders are arranged on the runs of the drying wire and the web both from a large cylinder to a small cylinder and from a small cylinder to a large cylinder. The centers of the reversing cylinders are placed on a level or levels substantially different from the corresponding levels of the large cylinders and the small cylinders. The level of the small cylinders is between the level of the large cylinders and the level or levels of the reversing cylinders. The large cylinders forming the pairs of adjacent large cylinders between which a respective small cylinder is placed are preferably discrete pairs, i.e., each large cylinder is part of only one adjacent pair of large cylinders, so that at least two large cylinders remain adjacent one another without the interposition of a small cylinder. Also, the adjacent pair of large cylinders may comprise a large cylinder in one wire loop and a large cylinder in another wire loop.

In a preferred embodiment of the invention, the reversing cylinders placed between the large cylinders are also placed at a level slightly higher than the other reversing cylinders, in which case, the draws of the web between the large cylinders and the reversing cylinders can be additionally shortened.

In a dryer section composed of drying groups in accordance with the invention, all or most of the groups with single-wire draw in the dryer section are such groups as described above in which the large cylinders are placed on the highest level, the small cylinders on the second highest level, and the reversing cylinders on the lowest level, and the web has a closed draw in all or several of the group gaps between the groups. This type of single-wire draw group is a normal single-wire draw group. If the reversing cylinders placed between the large cylinders are placed at two different levels to shorten the web draws, the reversing cylinders are placed in the lowest two levels.

In a dryer section composed of drying groups in accordance with the invention, one or most of the groups with single-wire draw in the dryer section are such groups as described above in which the large cylinders are placed on the lowest level, the small cylinders on the second lowest level, and the reversing cylinders on the highest level or levels, and the web has a closed draw in all or several of the group gaps between the groups. This type of single-wire draw group is an inverted single-wire draw group.

In a dryer section in accordance with the present invention, the hot coverage on the drying cylinders within a certain length in the machine direction can be made larger than in the prior art, by means of which the overall length of the dryer section can be shortened further. According to preliminary estimates, by means of a dryer section in accordance with the present invention, compared with the SYM-RUN™ concept applied by the current assignee, the length of the dryer section can be shortened by about 15%, and by about 10% when the geometry in accordance with the present invention is compared with the geometry in accordance with the current assignee's Finnish Patent Application No. 940992. The shortening arises from the fact that the hot coverage length of the paper web per unit of length of the dryer section is substantially longer in a dryer section in accordance with the invention. This is a valuable advantage because the cost of investment of a new paper machine hall can be reduced substantially. Also, in modernizations of paper machines, the drying capacity can be increased with the existing length of the dryer section, for example, for increase in the running speed of the paper machine or for change of paper grade. A typical change of paper grade is to provide the dryer section of a paper machine with a surface-sizing device and with a following finishing-dryer, for which space can be arranged owing to the present invention because the dryer section to be modernized can be made shorter accordingly.

It is a second important advantage of the invention that the ease of servicing and the ease of tending of the paper machine remain good because the tending platform can be maintained as one single platform, which is not the case when so-called vertical dryers are used. Moreover, the runnability of the dryer section in accordance with the invention remains obviously good because a mode of transfer of the web is employed that is substantially equivalent to a conventional single-wire draw as provided with suction cylinders or suction rolls.

It is a further advantage of a dryer section in accordance with the invention that ropeless tail threading can be applied favorably over its entire length.

In another embodiment of the invention, the group with single-wire draw comprises heated drying cylinders each having a smooth face against which a paper web to be dried is brought into direct contact, reversing cylinders each arranged in a respective gap between an adjacent pair of drying cylinders, a drying wire for supporting the web, and guide rolls for guiding the drying wire in a loop such that the drying cylinders are situated outside the wire loop and the reversing cylinders are situated inside the wire loop. The drying cylinders comprise at least one small cylinder and at least one pair of large cylinders each having a diameter larger than a diameter of the small cylinder(s). The small cylinder(s) is/are arranged such that a center of rotation thereof is situated at a first level different than a second level at which centers of rotation of the large cylinders are situated. The large cylinders in each pair of large cylinders are arranged adjacent one another and each small cylinder is arranged adjacent one large cylinders of a respective pair of large cylinders. Each reversing cylinder has a center of rotation situated at at least one additional level different than the first and second levels. The reversing cylinders, small cylinders and large cylinders are arranged such that the first level is between the second level and each additional level. The guide rolls are arranged to guide the drying wire and the web supported thereon in a run between the small cylinder and the adjacent large cylinders of the respective pair of large cylinders, and between the large cylinders in the respective pair of large cylinders.

The method for reducing the length of a dryer section of a paper machine comprises the steps of arranging at least one pair of large cylinders at a first height level, arranging at least one small cylinder having a diameter smaller than a diameter of the large cylinders at a second height level different than the first height level and adjacent one of the large cylinders in a respective pair of large cylinders while maintaining the respective pair of large cylinders adjacent one another without the interposition of a small cylinder therebetween, arranging reversing cylinders at at least one additional height level different than the first and second height levels, the second level being between the first level and each additional level, and supporting a web on a drying wire and passing the drying wire supporting the web thereon between the small cylinder and the adjacent large cylinder and between the large cylinders. At least one additional large cylinder may be arranged adjacent each small cylinder such that the small cylinder is placed between two large cylinders, in which case, the drying wire passes between the small cylinder and each adjacent large cylinders. The first level of large cylinders may be arranged above the second level of small cylinders and the additional level(s) of reversing cylinders to thereby provide a normal single-wire draw group, or in the alternative, the first level of large cylinders may be arranged below the second level of small cylinders and the additional level(s) of reversing cylinders to thereby provide an inverted single-wire draw group. The normal and inverted groups may be combined in a single dryer section.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
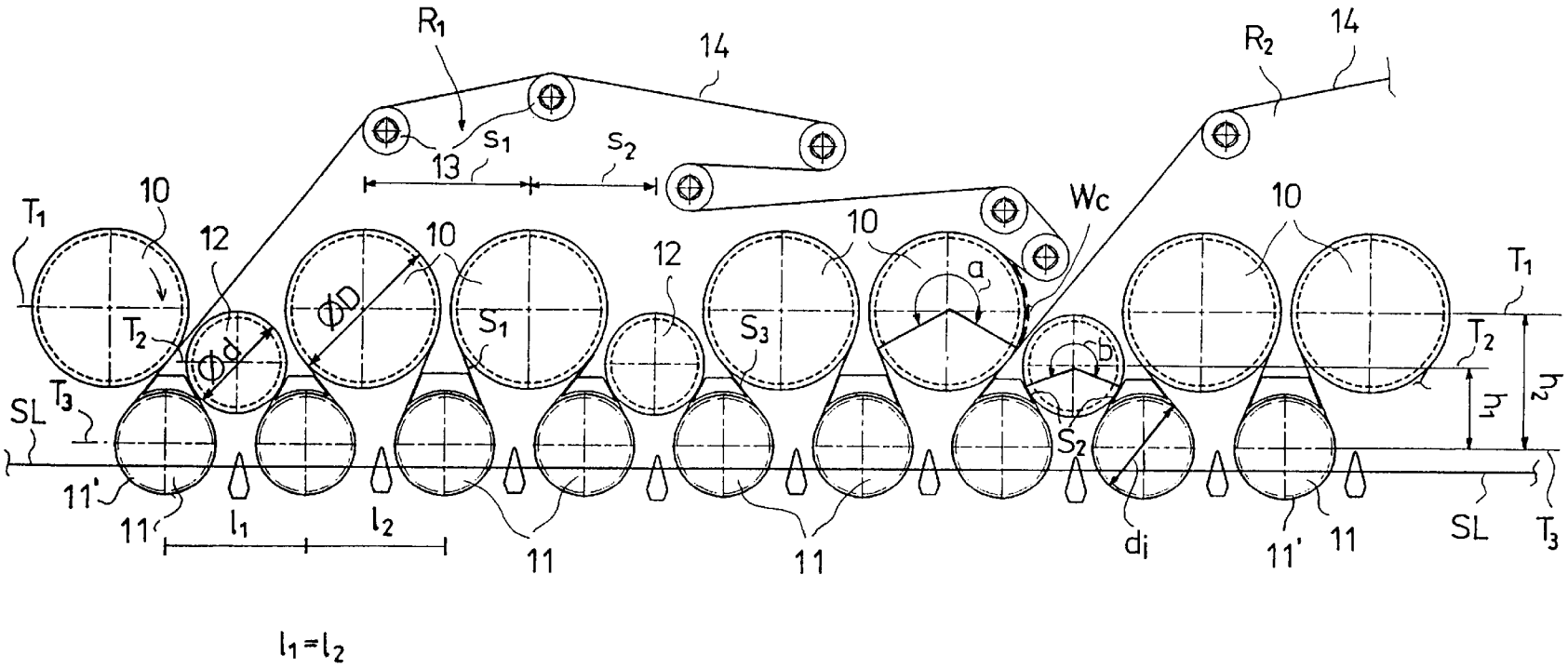
FIG. 1 is a schematic side view of two successive groups with single-wire draw in accordance with the invention without frame constructions.
Figure 2:
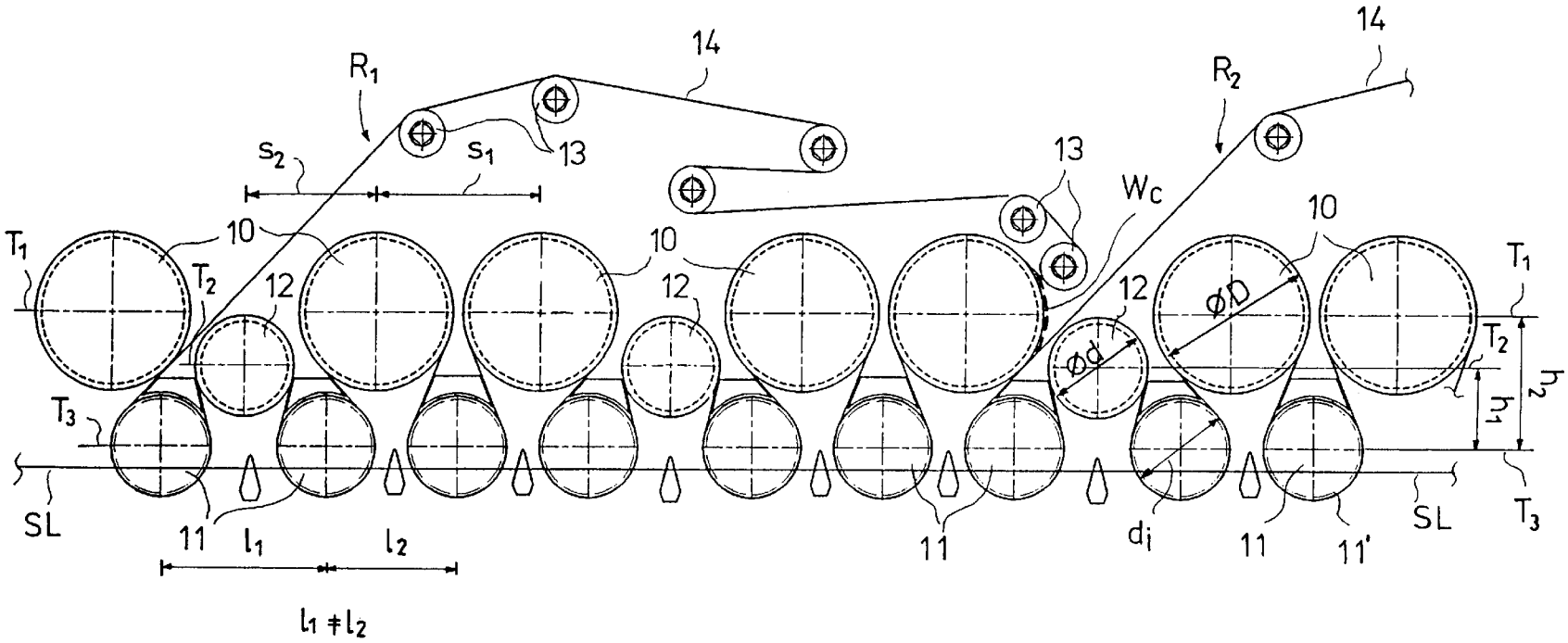
FIG. 2 shows a second variation of the invention similarly to FIG. 1.
Figure 3:
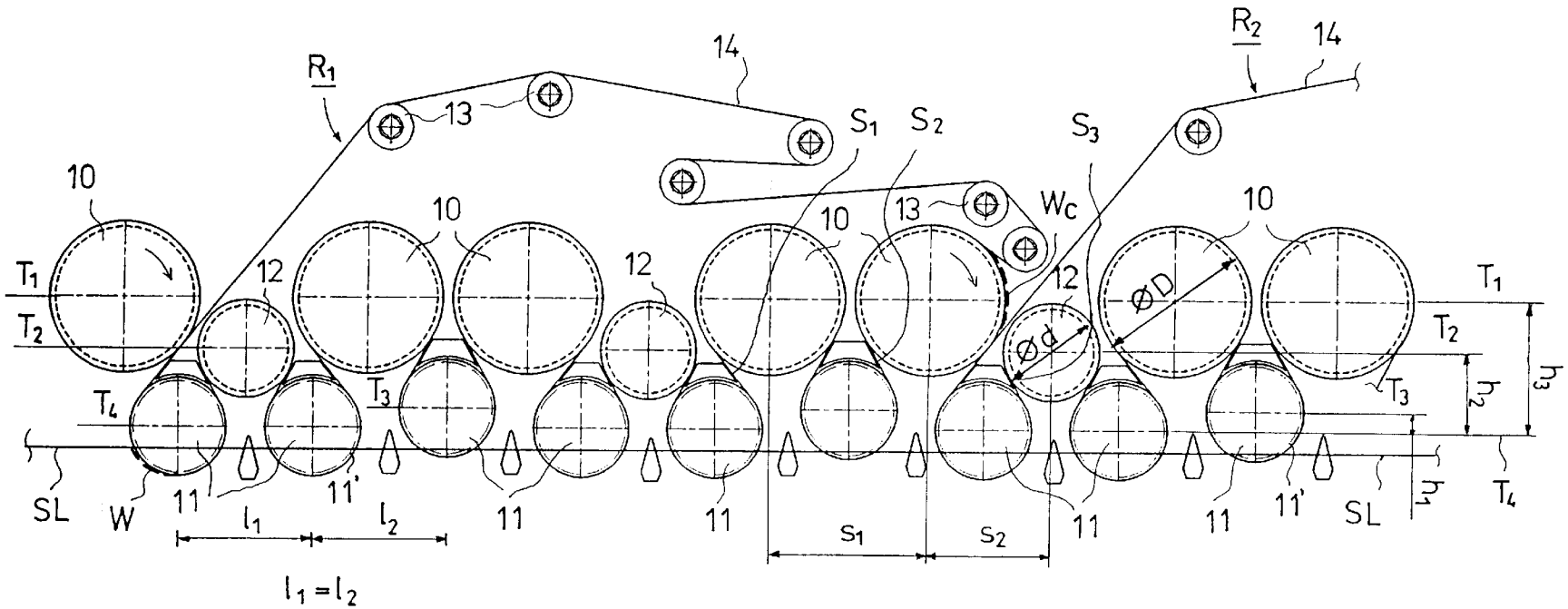
FIG. 3 shows a third variation of the invention similarly to FIGS. 1 and 2.
Figure 4:
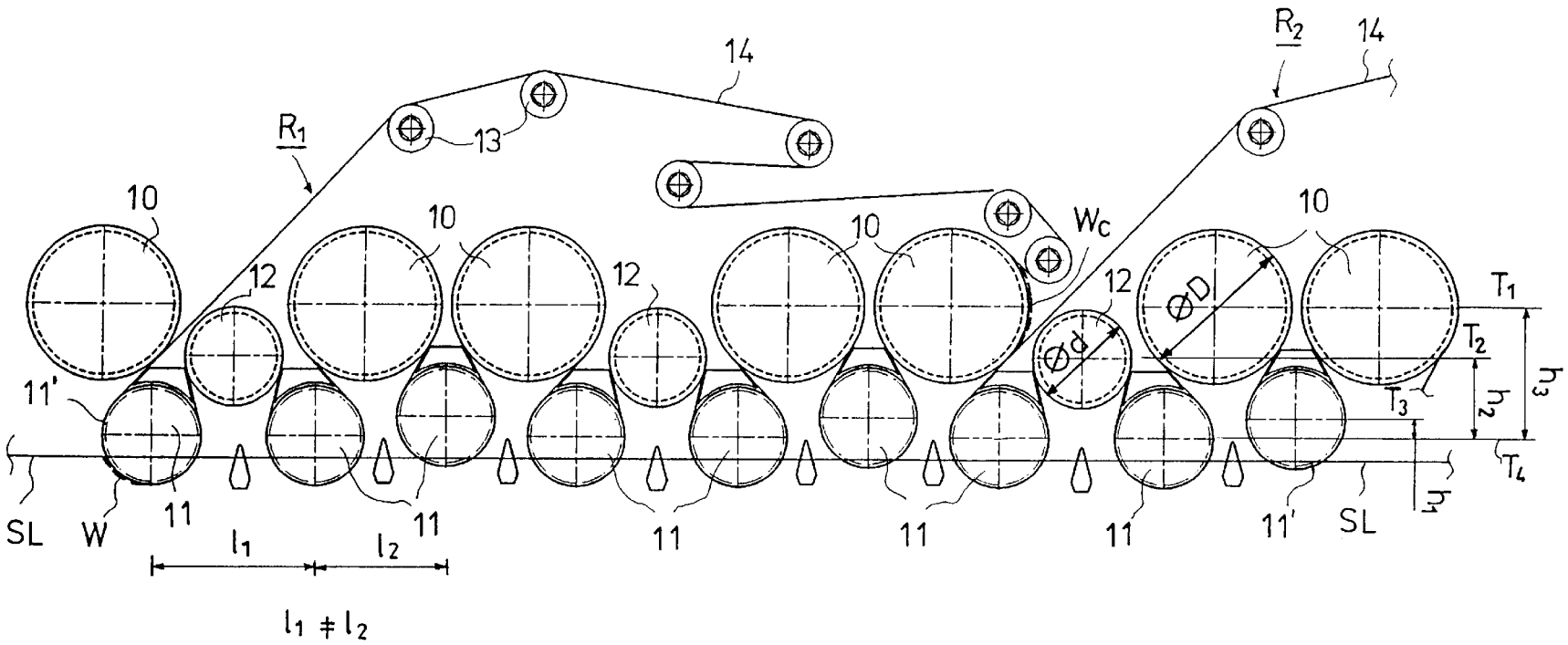
FIG. 4 shows a fourth variation of the invention similarly to FIGS. 1, 2 and 3.

Referring to FIGS. 1–8 wherein like reference numerals refer to the same or similar elements, initially, with reference to FIGS. 1–4, the general principles and the common features of the construction of a group with single-wire draw in accordance with the invention will be described. Two successive wire groups $R_1$ and $R_2$ shown in FIGS. 1–4 are in most respects substantially similar to prior art normal (not inverted) drying groups except that the dryer section includes contact drying cylinders 10,12 of two different diameters D,d, which cylinders are placed in a very compact setting so that two large drying cylinders 10 (hereinafter referred to as large cylinders 10) are placed one after the other, and they are followed by a small-diameter drying cylinder 12 (hereinafter referred to as a small cylinder 12). The large cylinders 10 of larger diameter D are placed on the highest level $T_1$, i.e., the axis or center of rotation of the large cylinders is at the level $T_1$, and the small cylinders 12 of smaller diameter d are placed on a lower level $T_2$, i.e., the axis or center of rotation of the small cylinders is at the level $T_2$, the difference in height between the levels, $T_1$–$T_2$, being $h_2$–$h_1$, the height being measured between the level $T_3$ and the respective level $T_1$, $T_2$. In the gaps between the drying cylinders 10,12, reversing cylinders 11 having a diameter di are placed at the level $T_3$, i.e., the axis or center of rotation of the reversing cylinders is at the level $T_3$, which is substantially lower than the levels $T_1$ and $T_2$. The reversing cylinders 11 can also be placed in two levels $T_3$ and $T_4$ (FIGS. 3 and 4). Further, the reversing cylinders 11 can also be placed in other ways asymmetrically in relation to the contact drying cylinders 10,12. A paper web W to be dried runs through the drying groups $R_1$, $R_2$ on support of drying wires 14 guided by leading rolls 13, so that, on the reversing cylinders 11, the web W remains at the side of the outside curve, and on the drying cylinders 10,12, the web W is pressed by the drying wire 14 into direct contact against the heated faces of the drying cylinders 10,12. In the invention, the diameters of the large cylinders 10, the small cylinders 12, and the reversing cylinders 11 are selected either so that D>d>di, or D>d=di.

By means of the invention, a particularly compact dryer section is accomplished so that, per meter of horizontal length of the dryer section in the machine direction, substantially more "hot coverage" is obtained as compared with prior art constructions. This is achieved partly thereby that considerably larger covering sectors a and b are obtained on the drying cylinders 10,12 (FIG. 1). Covering sectors a and b are typically in a range of a being from about 220° to about 280° and b being from about 200° to about 260°. In one preferred embodiment, covering sector a is from about 235° to about 265° and covering sector b is from about 210° to about 250°.

The web W is kept reliably on support of the wire 14 in its run about the reversing cylinders 11 against the effects of centrifugal forces by the effect of the vacuum present in grooved faces 11' of the reversing cylinders 11, whereby transverse shrinkage of the web W is also counteracted. The reversing suction cylinders 11 that are used are preferably suction cylinders marketed by the current assignee with the trade mark VAC-ROLL™, which cylinders lack an interior suction box and with respect to the details of whose constructions reference is made to the current assignee's Finnish Patent No. 83,680 (corresponding to U.S. Pat. No. 5,022,163). However, it should be emphasized that the scope of the invention also includes dryer sections in which, in the positions of the reversing cylinders 11, ordinary suction rolls provided with inside suction boxes are used, also including suction rolls of quite small diameters. Normal suction rolls are, however, in this connection, not equally favorable as the VAC-ROLL™ rolls. In some special cases, as reversing cylinders 11, it is also possible to use other cylinders or rolls besides the suction cylinders or rolls provided with inside vacuum and with perforated mantles, for example rolls provided with solid mantles and grooved faces, marketed by the current assignee with the trade mark UNO-ROLL™, in whose grooves a slight negative pressure is produced by means of ejection blowers arranged in wedge spaces between the mantles of these rolls and the drying wire. In exceptional cases, even smooth rolls can be used as the reversing cylinders 11 if the speed and runnability of the machine permit.

In the exemplifying embodiment shown in FIG. 1, the first drying cylinder in each wire group $R_1$, $R_2$, . . . is a small cylinder 12 (smaller diameter d), and the last cylinder is a large cylinder 10 (larger diameter D), on whose free sector the web W is transferred as a closed draw WC onto the wire 14 in the next group and further onto the first reversing cylinder 11. A similar arrangement is illustrated in FIG. 2. FIGS. 1 and 2 differ from one another in the respect that in FIG. 1, the horizontal spacing $l_1$ of the reversing cylinders 11 placed at both sides of the small cylinders 12 is equal to the spacing $l_2$ of the reversing cylinders 11 placed at both sides of the large cylinders 10, i.e., $l_1=l_2$, whereas, in FIG. 2, $l_1>l_2$. In all of the embodiments shown in FIGS. 1–4, the horizontal spacing of the large and small cylinders 10,12 in relation to one another is arranged so that the mutual spacing $s_1$ of the large cylinders 10 is larger than the spacing $s_2$ between large and small cylinders 10,12, i.e., $s_1>s_2$, both within a group and in the group gaps between the groups $R_1$, $R_2$ . . . , in which preferably a closed draw WC is employed. In group gaps, the spacing may also be different.

The dryer sections illustrated in FIGS. 1 and 2 differ from the wire groups $R_1$, $R_2$ illustrated in FIGS. 3 and 4 in the respect that, in FIGS. 3 and 4, the reversing cylinders 11 are arranged in two levels $T_3$ and $T_4$. For this reason, in FIGS. 3 and 4, the lengths $S_1 \approx S_2 \approx S_3$ of the straight runs of the wire 14 and the web W arriving on the large cylinders 10 can be made substantially shorter. The lengths of the runs $S_1$, $S_2$ and $S_3$ are generally selected in the range of from about 500 mm to about 1500 mm. Moreover, FIGS. 3 and 4 differ from one another in the same way as FIGS. 1 and 2 differ from one another in the respect that, in FIGS. 1 and 3, the horizontal spacing of the reversing cylinders 11 is equal spacing $l_1=l_2$, whereas, in FIGS. 2 and 4, $l_1>l_2$.

It is an important feature of certain embodiments of the invention that the horizontal spacing $s_2$ of the large and small cylinders 10,12 is shorter than the diameter of the large cylinder, i.e., $s_2<D$. Most appropriately, the mutual proportion of the quantities $s_2$ and D is selected such that the small and the large cylinders 10,12 could not be arranged on the same level even in theory, i.e., $s_2<(D+d)/2$, which selection further improves the ratio of hot coverage to overall length of the dryer section. As stated above, the reversing cylinders 11 can be positioned either with equal spacing $l_1=l_2$ or with variable spacing, in which case $l_1>l_2$. Then, by selecting $l_1+l_2=2\times s$ with variable spacing, in different geometries it is possible to maximize the drying capacity per meter of length of the dryer section in the machine direction. In a particularly favorable embodiment of the invention, the horizontal spacing $s_1$ of the large cylinders is larger than the corresponding horizontal spacing $s_2$ of an adjacent large cylinder 10 and small cylinder $l_2$, i.e., $s_1>s_2$.

In the accompanying drawings, the tending platform of the paper machine is represented by the line SL—SL. From this single platform, the dryer section can be tended and serviced across its entire length.

In the following table, four different examples of dimensioning I, . . . , IV of the invention are given. Moreover, in view of facilitating a comparison, in the last column the corresponding dimensioning parameters are given concerning a prior-art "SYM-RUN"™ single-wire concept employed by the current assignee. In the following table, $S_1$, $S_2$ and $S_3$ denote lengths of the straight joint draws of the wire 14 and the web W from the drying cylinders 10,12 to the suction cylinders 11 and vice versa, these draws being indicated in FIG. 1.

| Parameter | I | II | III | IV | SymRun |
|---|---|---|---|---|---|
| D | 2350 | 2500 | 2200 | 2350 | 1830 |
| d | 1500 | 1500 | 1500 | 1500 | 1830 |
| di | 1500 | 1500 | 1500 | 1500 | 1500 |
| $s_1$ | 2500 | 2650 | 2375 | 2500 | 2100 |
| $s_2$ | 1900 | 1825 | 1900 | 1900 | 2100 |
| $l_1$ | 2300 | 2300 | 2300 | 2100 | 2100 |
| $l_2$ | 2000 | 2000 | 2000 | 2100 | 2100 |
| $h_1$ | 300 | 500 | 300 | 350 | 0 |
| $h_2$ | 1200 | 1100 | 1200 | 1250 | 1600 |
| $h_3$ | 2000 | 2200 | 1900 | 2050 | 1600 |
| a | 253.3 | 253.5 | 255.0 | 247.1 | 234.4 |
| b | 253.3 | 253.5 | 255.0 | 246.5 | 234.4 |
| c | 221.4 | 228.4 | 221.4 | 233.5 | 234.4 |
| $S_1$ | 926 | 1138 | 866 | 1104 | 944 |
| $S_2$ | 864 | 804 | 740 | 864 | 944 |
| $S_3$ | 716 | 532 | 716 | 644 | 944 |

For the measures indicated in FIGS. 1–3, with different dimensioning parameters, suitable and preferred ranges of proportions are, for example:

$l_1$/sn=about 1.0 to about 1.5

$l_2$/sn=about 0.7 to about 1.0

$h_1$/sn=0 to about 0.4

$h_2$/sn=about 0.4 to about 0.8

$h_3$/sn=about 0.7 to about 1.2

D/di=about 1.4 to about 3.5 d/di=about 1.0 to about 3.5

(note: sn=$s_1$ or $s_2$)

In view of the objectives of the invention, particularly suitable ranges of measures of the various parameters are, for example:

D≈1800 mm to 2600 mm, preferably 2200 mm to 2500 mm, d≈1200 mm to 2000 mm, preferably 1400 mm to 1900 mm, di≈600 mm to 1800 mm, preferably 1200 mm to 1500 mm.

In the following, a preferred example of dimensioning of the wire groups as shown in FIGS. 1–4 will be given.

FIG. 1. Equal horizontal spacing of reversing cylinders 11, wherein $s_1$≈2500 mm, $s_2$≈1900 mm, $l_1$=$l_2$≈2100 mm, D=2350 mm, d=1500 mm, di=1500 mm, $h_1$=300 mm, $h_2$=1200 mm, and $h_3$=2000 mm.

FIG. 2. Embodiment of variable horizontal spacing of reversing cylinders 11 with diameters of FIG. 1, but $s_1$≈2500 mm, $s_2$≈1900 mm, $l_1$=2500 mm, $l_2$=2000 mm, $h_1$=300 mm, $h_2$=1200 mm, and $h_3$=2000 mm.

FIG. 3. Exemplifying embodiment of equal spacing of reversing cylinders 11 ($l_1$=$l_2$= 2100 mm) with diameters of FIG. 1, wherein $h_1$=300 mm, $h_2$=1200 mm, and $h_3$=2000 mm.

FIG. 4. Embodiment of variable horizontal spacing of reversing cylinders 11 with diameters of FIG. 1, wherein $l_1$=2500 mm, $l_2$=2000 mm, h=300 mm, $h_2$=1200 mm, and $h_3$=2000 mm.

Figure 5:
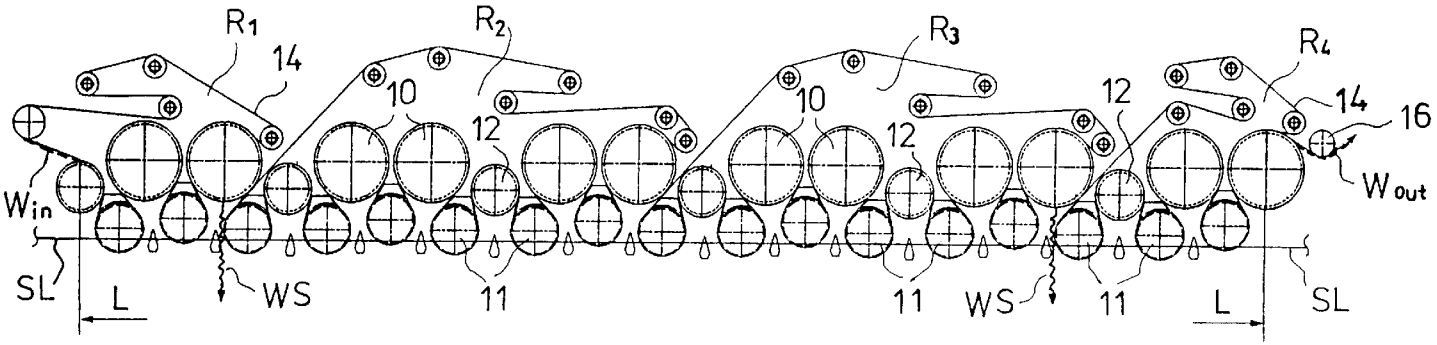
FIG. 5 shows a first exemplifying embodiment of a dryer section including groups with single-wire draw in accordance with the invention.

FIGS. 5–8 show some preferred exemplifying embodiments in which, utilizing wire groups $R_1$, . . . $R_N$ in accordance with the invention, it is possible to construct dryer sections whose overall length L is shorter than prior art dryer sections. In FIG. 5, the dryer section comprises four successively arranged normal (not inverted) groups $R_1$, . . . , $R_4$ with single-wire draw in accordance with the invention. In the groups $R_2$ and $R_3$, there are four large cylinders 10 and two small cylinders 12 and six reversing cylinders 11. In the first group $R_1$, there are just two large cylinders 10 and one small cylinder 12 and two reversing cylinders 11. In FIG. 5, the arrows WS illustrate the removal of paper broke, which can take place, in a dryer section of FIG. 5, over its entire length by means of gravity onto the broke conveyor (not shown) placed underneath.

Figure 6:
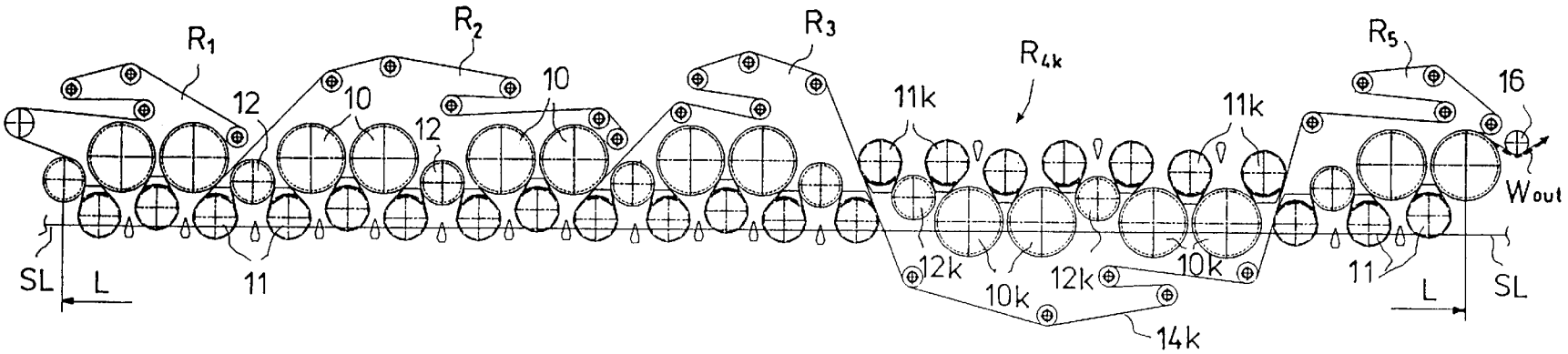
FIG. 6 is an illustration similar to FIG. 5 of a dryer section including groups with single-wire draw in accordance with the invention and in which there is one inverted group in accordance with the invention.

In FIGS. 5 and 6, the web W is passed from the press section (not shown) of the paper machine to the first group $R_1$, which passing is represented by the reference $W_{in}$, and similarly the dried web W is removed while guided by the leading roll 16, which is represented by the reference $W_{out}$.

In FIG. 5, the overall length L of the dryer section is, according to preliminary estimates, about 15% shorter than the length of a dryer section of the SYM-RUN™ concept that has an equivalent drying capacity.

FIG. 6 illustrates an embodiment which is in most respects similar to the embodiment shown in FIG. 5, but in which the penultimate (third) wire group is an inverted group $R_{4k}$ in accordance with the invention. In the inverted group $R_{4k}$, the lower cylinders consist of four large cylinders 10*k*, the middle cylinders consist of two small cylinders 12*k*, and the upper cylinders consist of seven reversing cylinders 11*k*. Between all of the groups $R_1$, $R_2$, $R_3$, $R_{4k}$, and $R_5$, the web W has a closed and supported draw. The inverted group $R_{4k}$, in a way in itself known, contributes to ensuring a sufficiently symmetric drying, i.e., the fact that the web W is dried from both of its sides with an adequate capacity so as to reduce the tendency of curling of the web.

Figure 7:
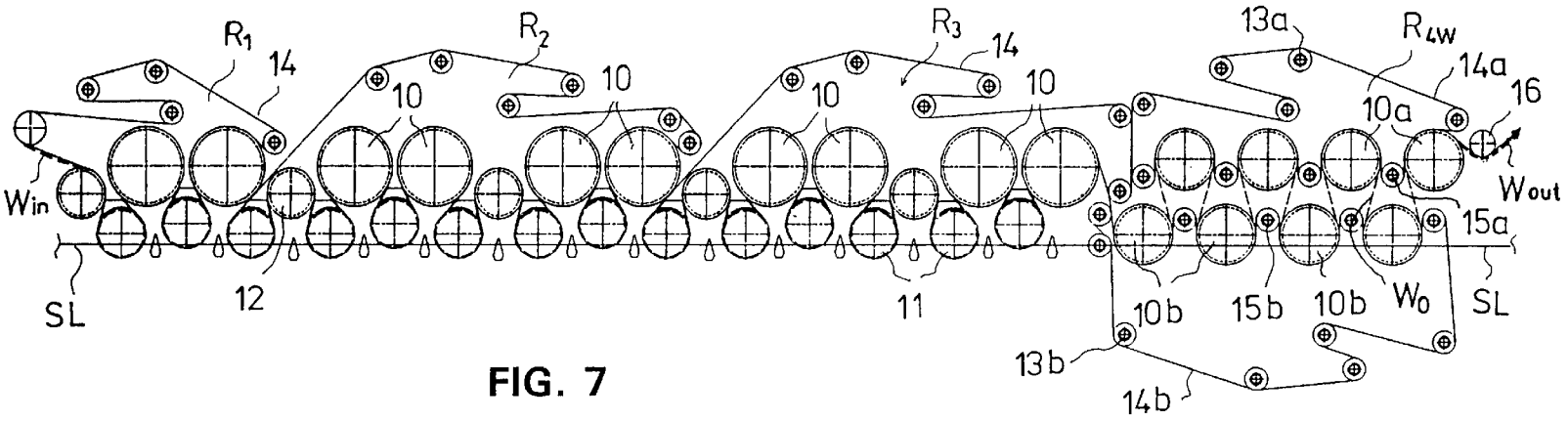
FIG. 7 is an illustration similar to FIGS. 5 and 6 of a dryer section in which, in the initial end and over most of the length of the dryer section, there are normal (not inverted) drying groups in accordance with the invention and in which the last group is a group with twin-wire draw.

FIG. 7 shows a dryer section that is in most respects similar to FIG. 5, except that the last group is a twin-wire group $R_{4TW}$. In this group $R_{4TW}$, in a way in itself known, there are two rows of contact-drying cylinders 10*a* and 10*b* and reversing rolls 15*a*, 15*b* in the gaps between these contact-drying cylinders. The twin-wire group $R_{4TW}$ includes an upper wire 14*a*, which is guided by the leading rolls 13*a* and the reversing rolls 15*a* as well as by the upper cylinders 10*a*, and a lower wire 14*b*, which is arranged in a similar way and is guided by the leading rolls 13*b* and the reversing rolls 15*b* as well as by the lower cylinders 10*b*. Between the rows of cylinders 10*a* and 10*b*, the web W has free draws $W_0$. As an alternative, it is possible to use such a positioning of the leading rolls 15*a*, 15*b* that the free draws $W_0$ can be made shorter or even entirely closed. The free draws $W_0$ provide the advantage that in their areas, the web has a possibility to relax from drying strains.

Figure 8:
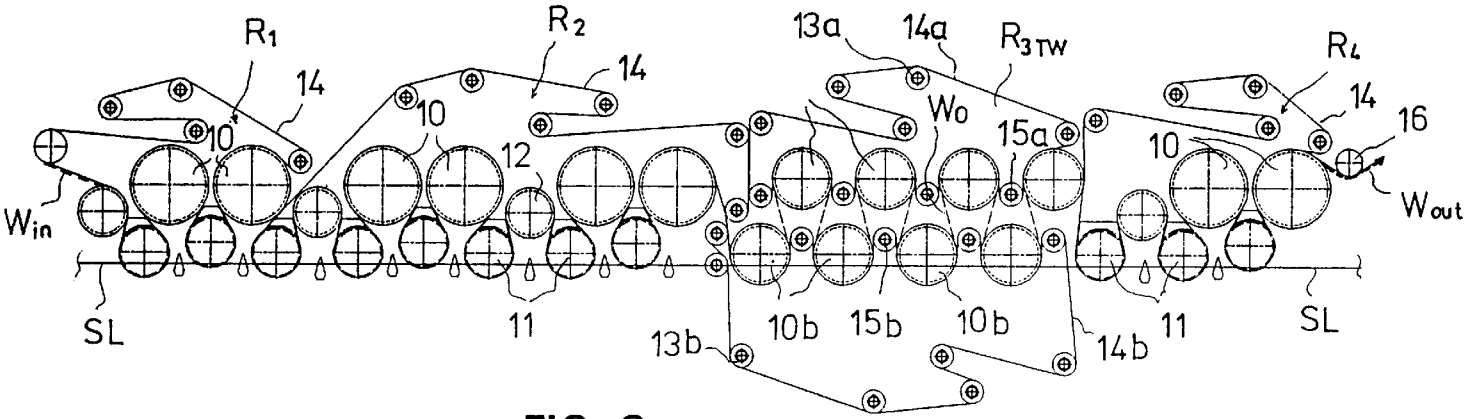
FIG. 8 shows a variation of the invention in which there are initially two normal (not inverted) drying groups in accordance with the invention and after that one group with twin-wire draw and finally one non-inverted group with single-wire draw in accordance with the invention.

FIG. 8 differs from FIG. 7 in the respect that the twin-wire group $R_{3TW}$ is placed as the second last group in the dryer section, and the last group $R_4$ is a normal (not inverted) single-wire group in accordance with the invention. The particular advantages of this location of the group with twin-wire draw $R_{3TW}$ are disclosed in the current assignee's Finnish Patent Application 940749 (filed Feb. 17, 1994).

The dryer section in accordance with the invention is composed of a number of successive groups $R_1$, . . . , $R_N$ with single-wire draw, of which several, preferably most of them as a rule with the exception of one group $R_{4TW}$, $R_{3TW}$ with twin-wire draw, are compact groups in accordance with the invention. Depending on the requirement of capacity of the dryer section, the number N of the groups $R_1$, . . . , $R_N$ is selected within the range of N=3–8, preferably N=4–6.

In the dryer sections as shown in FIGS. 5–8, it is possible to apply so-called ropeless tail threading over their entire length. In such a case, as the reversing cylinders 11, it is necessary to use cylinders subjected to a vacuum, so that the lead-in strip can be made to adhere to the drying wire 14 on the turning sectors of the reversing cylinders 11 by the effect of the negative pressure. In ropeless tail threading, it is additionally possible to employ various blower means in themselves known, by whose means the tail threading is ensured at problematic points, such as group gaps or equivalent.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

I claim:

1. In a group with single-wire draw in a dryer section of a paper machine, including heated drying cylinders each having a smooth face against which a paper web to be dried is brought into direct contact, reversing cylinders each arranged in a respective gap between an adjacent pair of said drying cylinders, a drying wire for supporting the web and guide rolls for guiding said drying wire in a loop such that said drying cylinders are situated outside said wire loop and said reversing cylinders are situated inside said wire loop, the improvement comprising:

said drying cylinders comprising at least one small cylinder and large cylinders each having a diameter larger than a diameter of said at least one small cylinder, each of said at least one small cylinder being situated in a gap between a respective, adjacent pair of said large cylinders, at least two of said large cylinders being arranged adjacent one another without the interposition of one of said at least one small cylinder, said at least one small cylinder being arranged such that a center of rotation of said at least one small cylinder is situated at a first level different than a second level at which centers of rotation of said large cylinders are situated, said reversing cylinders being arranged relative to said drying cylinders to provide runs for said drying wire and the web supported thereon between said at least one small cylinder and each of said respective, adjacent pair of said large cylinders, each of said reversing cylinders having a center of rotation situated at at least one additional level different than said first and second levels, said reversing cylinders, said small cylinders and said large cylinders being arranged such that said first level is between said second level and each of said at least one additional level.

2. The single-wire draw group of claim 1, wherein the distance between said at least two of said large cylinders arranged adjacent one another without the interposition of one of said at least one small cylinder is larger in a machine direction than the distance between said at least one small cylinder and one of said large cylinders of said respective, adjacent pair of said large cylinders.

3. The single-wire draw group of claim 1, wherein said large cylinders have a common diameter, the distance between said at least one small cylinder and one of said large cylinders of said respective, adjacent pair of said large cylinders is less than one-half of the sum of the diameter of said at least one small cylinder and the diameter of said large cylinders.

4. The single-wire draw group of claim 1, wherein said at least one small cylinder comprises at least two small cylinders, said first, second and at least one additional levels being horizontal levels.

5. The single-wire draw group of claim 1, wherein all of said reversing cylinders each have a center of rotation situated at only one additional level different than said first and second levels.

6. The single-wire draw group of claim 1, wherein said reversing cylinders each have a center of rotation situated at two additional levels different than said first and second levels.

7. The single-wire draw group of claim 6, wherein said large cylinders, said at least one small cylinder and said reversing cylinders are arranged such that a ratio of the distance in the machine direction between a pair of said reversing cylinders surrounding a respective one of said at least one small cylinder to the distance between an adjacent pair of said drying cylinders is from about 1.0 to about 1.5, a ratio of the distance in the machine direction between a pair of said reversing cylinders surrounding a respective one of said large cylinders to the distance between an adjacent pair of said drying cylinders is from about 0.7 to about 1.0, a ratio of the difference in height between a first one of said two additional levels and a second one of said two additional levels to the distance between an adjacent pair of said drying cylinders is from 0 to about 0.4, a ratio of the difference in height between said first level and each of said at least one additional level to the distance between an adjacent pair of said drying cylinders is from about 0.4 to about 0.8, and a ratio of the difference in height between said second level and each of said at least one additional level to the distance between an adjacent pair of said drying cylinders is from about 0.7 to about 1.2.

8. The single-wire draw group of claim 1, wherein said large cylinders have a common diameter and said reversing cylinders have a common diameter, a ratio of the diameter of said large cylinders to the diameter of said reversing cylinders being from about 1.4 to about 3.5, the ratio of the diameter of said at least one small cylinder to the diameter of said reversing cylinders being from about 1.0 to about 3.5.

9. The single-wire draw group of claim 1, wherein said large cylinders, said at least one small cylinder and said reversing cylinders are arranged such that a ratio of the distance in the machine direction between a pair of said reversing cylinders surrounding a respective one of said at least one small cylinder to the distance between an adjacent pair of said drying cylinders is from about 1.0 to about 1.5, a ratio of the distance in the machine direction between a pair of said reversing cylinders surrounding a respective one of said large cylinders to the distance between an adjacent pair of said drying cylinders is from about 0.7 to about 1.0, a ratio of the difference in height between said first level and each of said at least one additional level to the distance between an adjacent pair of said drying cylinders is from about 0.4 to about 0.8, and a ratio of the difference in height between said second level and each of said at least one additional level to the distance between an adjacent pair of said drying cylinders is from about 0.7 to about 1.2.

10. The single-wire draw group of claim 1, wherein the diameter of each of said large cylinders is from about 1800 mm to about 2600 mm, the diameter of each of said at least one small cylinder is from about 1200 mm to about 2000 mm, and the diameter of each of said reversing cylinders is from about 600 mm to about 1800 mm.

11. The single-wire draw group of claim 1, wherein the diameter of each of said large cylinders is from about 2200 mm to about 2500 mm, the diameter of each of said at least one small cylinder is from about 1500 mm to about 1900 mm, and the diameter of each of said reversing cylinders is from about 1200 mm to about 1500 mm.

12. The single-wire draw group of claim 1, wherein said drying wire is arranged to press the web against each of said large cylinders over a circumferential portion thereof having a magnitude from about 220° to about 280° and to press the web against each of said at least one small cylinder over a circumferential portion thereof having a magnitude from about 200° to about 260°.

13. The single-wire draw group of claim 1, wherein said drying wire is arranged to press the web against each of said large cylinders over a circumferential portion thereof having a magnitude from about 235° to about 265° and to press the web against each of said at least one small cylinder over a circumferential portion thereof having a magnitude from about 210° to about 250°.

14. The single-wire draw group of claim 1, wherein the distance between adjacent ones of said large cylinders, said at least one small cylinder and said reversing cylinders is substantially equal and from about 1800 mm to about 2400 mm.

15. The single-wire draw group of claim 1, wherein said reversing cylinders are substantially uniformly spaced in relation to one another in a machine direction such that the distance between said at least two of said large cylinders arranged adjacent one another without the interposition of one of said at least one small cylinder in the machine direction is larger than the distance between said at least one small cylinder and one of said large cylinders of said respective, adjacent pair of said large cylinders.

16. The single-wire draw group of claim 1, wherein said drying cylinders are nonuniformly spaced in a machine direction such that the distance between said at least two of said large cylinders arranged adjacent one another without the interposition of one of said at least one small cylinder in the machine direction is larger than the distance between said at least one small cylinder and one of said large cylinders of said respective, adjacent pair of said large cylinders.

17. The single-wire draw group of claim 1, wherein said large cylinders, said at least one small cylinder and said reversing cylinders are situated such that said second level is situated above said first level and said at least one additional level whereby the single-wire draw group is a normal single-wire draw group.

18. The single-wire draw group of claim 1, wherein said large cylinders, said at least one small cylinder and said reversing cylinders are situated such that said second level is situated below said first level and said at least one additional level whereby the single-wire draw group is an inverted single-wire draw group.

19. A dryer section of a paper machine comprising a plurality of the single-wire draw groups of claim 1, wherein in at least one of said single-wire draw groups, said large cylinders, said at least one small cylinder and said reversing cylinders are situated such that said second level is situated above said first level and said at least one additional level whereby said at least one single-wire draw group constitutes a normal single-wire draw group, the web having a closed draw in group gaps defined between adjacent one of said single-wire draw groups.

20. The dryer section of claim 19, wherein all of said single-wire draw dryer groups are normal groups.

21. The dryer section of claim 19, wherein in one of said single-wire draw groups, said large cylinders, said at least one small cylinder and said reversing cylinders are situated such that said second level is situated below said first level and said at least one additional level whereby said one single-wire draw group constitutes an inverted single-wire draw group.

22. The dryer section of claim 21, wherein said inverted group is arranged as the penultimate dryer group in the dryer section, in a last one of said single-wire draw groups, said large cylinders, said at least one small cylinder and said reversing cylinders being situated such that said second level is situated above said first level and said at least one additional level whereby said last single-wire draw group constitutes a normal single-wire draw group.

23. The dryer section of claim 19, further comprising a twin-wire draw dryer group including drying cylinders arranged in two rows and in which the web has open draws in gaps between said two rows of drying cylinders.

24. A group with single-wire draw in a dryer section of a paper machine, comprising heated drying cylinders each having a smooth face against which a paper web to be dried is brought into direct contact, said drying cylinders comprising at least one small cylinder and at least one pair of large cylinders each having a diameter larger than a diameter of said at least one small cylinder, said at least one small cylinder being arranged such that a center of rotation of said at least one small cylinder is situated at a first level different than a second level at which centers of rotation of said large cylinders are situated, said large cylinders in each of said at least one pair of large cylinders being arranged adjacent one another and each of said at least one small cylinder being arranged adjacent one of said large cylinders of a respective one of said at least one pair of large cylinders, reversing cylinders each arranged in a respective gap between an adjacent pair of said drying cylinders, each of said reversing cylinders having a center of rotation situated at at least one additional level different than said first and second levels, said reversing cylinders, said small cylinders and said large cylinders being arranged such that said first level is between said second level and each of said at least one additional level, a drying wire for supporting the web, and guide rolls for guiding said drying wire in a loop such that said drying cylinders are situated outside said wire loop and said reversing cylinders are situated inside said wire loop, said guide rolls being arranged to guide said drying wire and the web supported thereon in a run between said at least one small cylinder and said adjacent one of said large cylinders of the respective one of said at least one pair of large cylinders, and between said large cylinders in the respective one of said at least one pair of large cylinders.

25. The single-wire draw group of claim 24, wherein said large cylinders, said at least one small cylinder and said reversing cylinders are situated such that said second level is situated above said first level and said at least one additional level whereby the single-wire draw group is a normal single-wire draw group.

26. The single-wire draw group of claim 24, wherein said large cylinders, said at least one small cylinder and said reversing cylinders are situated such that said second level is situated below said first level and said at least one additional level whereby the single-wire draw group is an inverted single-wire draw group.

27. A method for reducing the length of a dryer section of a paper machine, comprising the steps of:

arranging at least one pair of large cylinders at a first height level, arranging at least one small cylinder having a diameter smaller than a diameter of said large cylinders at a second height level different than said first height level and adjacent one of said large cylinders in a respective one of said at least one pair of large cylinders while maintaining said at least one pair of large cylinders adjacent one another without the interposition of said at least one small cylinder therebetween, arranging reversing cylinders at at least one additional height level different than said first and second height levels, said second level being between said first level and each of said at least one additional level, and supporting a web on a drying wire and passing the drying wire supporting the web thereon between said at least one small cylinder and said adjacent one of said large cylinders of the respective one of said at least one pair of large cylinders, and between said large cylinders in the respective one of said at least one pair of large cylinders.

28. The method of claim 27, further comprising the step of:

arranging said first level of said large cylinders above said second level of said small cylinders and said at least one additional level of said reversing cylinders.

29. The method of claim 27, further comprising the step of:

arranging said first level of said large cylinders below said second level of said small cylinders and said at least one additional level of said reversing cylinders.

30. The method of claim 27, further comprising the step of:

arranging at least one additional large cylinder adjacent each of said at least one small cylinder such that said at least one small cylinder is placed between two of said large cylinders, the drying wire being passed between said at least one small cylinder and each of said adjacent large cylinders.

* * * * *

UNITED STATES PATENT AND TRADEMARK OFFICE

CERTIFICATE OF CORRECTION

PATENT NO. : 6,070,340
DATED : June 6, 2000
INVENTOR(S) : Lipponen, Juha

It is certified that error appears in the above-identified patent and that said Letters Patent is hereby corrected as shown below:

Title Page

[30] Foreign Priority Application Data, change:
April 28, 1997-971666; to -- April 18, 1997-971655 --

Signed and Sealed this

Twenty-first Day of August, 2001

*Attest:*

Nicholas P. Godici

NICHOLAS P. GODICI
*Acting Director of the United States Patent and Trademark Office*

*Attesting Officer*